US009216416B2

(12) United States Patent
Peltomaki et al.

(10) Patent No.: US 9,216,416 B2
(45) Date of Patent: Dec. 22, 2015

(54) WEAR PART, PROCESSING APPARATUS AND PROCESSING PLANT FOR MINERAL MATERIAL

(75) Inventors: Kari Peltomaki, Tampere (FI); Tero Onnela, Valkkinen (FI); Jouni Mahonen, Tampere (FI); Mikko Malkamaki, Palkane (FI)

(73) Assignee: Metso Minerals, Inc., Helsinki (FI)

( * ) Notice: Subject to any disclaimer, the term of this patent is extended or adjusted under 35 U.S.C. 154(b) by 331 days.

(21) Appl. No.: 13/642,049

(22) PCT Filed: Apr. 19, 2011

(86) PCT No.: PCT/FI2011/050351

§ 371 (c)(1), (2), (4) Date: Oct. 18, 2012

(87) PCT Pub. No.: WO2011/131835

PCT Pub. Date: Oct. 27, 2011

(65) Prior Publication Data

US 2013/0026272 A1 Jan. 31, 2013

(30) Foreign Application Priority Data

Apr. 23, 2010 (FI) ..... 20100169

(51) Int. Cl.
*B02C 2/04* (2006.01)
*B02C 2/00* (2006.01)

(52) U.S. Cl.
CPC ..... *B02C 2/005* (2013.01); *B02C 2210/02* (2013.01)

(58) Field of Classification Search
CPC ..... B02C 2/005; B02C 2/02–2/06; B02C 2002/002
USPC ..... 241/207–216, 300
See application file for complete search history.

(56) References Cited

U.S. PATENT DOCUMENTS

| | | | |
|---|---|---|---|
| 3,603,516 | A | 9/1971 | Decker |
| 2006/0086852 | A1 | 4/2006 | Juhlin |
| 2006/0163399 | A1 | 7/2006 | Cerda et al. |

FOREIGN PATENT DOCUMENTS

| | | | |
|---|---|---|---|
| CN | 2381401 | Y | 6/2000 |
| CN | 1655871 | A | 8/2005 |
| DE | 1280640 | B | 10/1968 |
| DE | 1 293 541 | B | 4/1969 |
| FI | 26837 | A | 2/1954 |

(Continued)

OTHER PUBLICATIONS

PCT Preliminary Report on Patentability dated May 16, 2012.

(Continued)

*Primary Examiner* — Mark Rosenbaum
(74) *Attorney, Agent, or Firm* — Andrus Intellectual Property Law, LLP

(57) ABSTRACT

A wear part for a mineral material processing apparatus includes an outer wear surface which comprises an initial phase wear surface to be put in crushing contact with an opposite wear surface, and an end phase wear surface to be taken vertically into use in the crushing process from under the initial wear surface when the wear is progressing. The wear part comprises an end phase wear surface with a protrusion to be put in use when the wear of the outer wear surface is progressing. By means of the protrusion working life of the wear part can be prolonged. A mineral material processing apparatus and a mineral material processing plant.

14 Claims, 5 Drawing Sheets

(56) References Cited

FOREIGN PATENT DOCUMENTS

| | | | |
|---|---|---|---|
| GB | 634464 | A | 3/1950 |
| JP | 62-160655 | U | 10/1987 |
| JP | 5076787 | A | 3/1993 |
| JP | 2748997 | B2 | 2/1998 |
| JP | 2002011363 | A | 1/2002 |
| JP | 2005-526609 | A | 9/2005 |
| SU | 791421 | A1 | 12/1980 |
| WO | 03/099443 | A1 | 12/2003 |

OTHER PUBLICATIONS

PCT International Search Report dated Apr. 23, 2010.

PCT Written Opinion of ISA dated Apr. 23, 2010.

Finnish Office Action dated Dec. 17, 2010.

Chinese Office Action dated Feb. 8, 2014.

Translation of Chinese Office Action dated Feb. 8, 2014.

Japanese Office Action issued in Application No. 2013-505510 and English Translation, dated Jan. 21, 2015.

Russian Office Action issued on Russian Application No. 2012147728 on Apr. 13, 2015, including English translation.

WEAR PART, PROCESSING APPARATUS AND PROCESSING PLANT FOR MINERAL MATERIAL

CROSS-REFERENCE TO RELATED APPLICATIONS

This application claims priority to PCT/FI2011/050351, filed Apr. 19, 2011, and published in English on Oct. 27, 2011 as publication number WO 2011/131835, which claims priority to FI Application No. 20100169, filed Apr. 23, 2010, incorporated herein by reference.

FIELD OF THE INVENTION

The invention relates to a wear part, a processing apparatus and a processing plant. The invention relates particularly, though not exclusively, to a wear part of a crusher, a crusher and a crushing plant which are suitable for crushing mineral material.

BACKGROUND OF THE INVENTION

Cone and gyratory crushers, among others, are used for crushing of mineral materials. The material which is crushed can be any mineral material such as ore, mined rock or gravel, different recyclable construction waste such as concrete, brick or asphalt. The material can also be waste collected in households such as wood, glass or small metal.

Gyratory and cone type crushers comprise typically an outer crushing blade and an inner crushing blade which is, for example, a crushing blade casted of manganese steel, a crushing chamber being formed there between. Crushing takes place when the inner crushing blade is put in an eccentric rotation movement in relation to the outer crushing blade.

Problem in the Prior Art

Crushing causes wear of crushing blades and changes the form of a crushing chamber. When the crushing blades wear they are altering more and more parallel so that power intake and crushing force of the crusher decrease resulting to reduction of crushing work made by the crusher which in turn affects negatively to a stability of the total process.

Poor performance of the crushing blades in the end period of the lifetime weakens an average performance of the total lifetime.

SHORT SUMMARY OF THE INVENTION

A wear part for a crusher has now been invented by means of which drawbacks in prior art as described above can be eliminated or at least reduced.

According to a first aspect of the invention there is provided a wear part for a mineral material processing apparatus, which wear part comprises an outer wear surface which comprises an initial phase wear surface to be put in crushing contact with an opposite wear surface, and an end phase wear surface to be taken vertically into use in the crushing process from under the initial wear surface when the wear is progressing. The wear part comprises an end phase wear surface with a protrusion to be put in use when the wear of the outer wear surface is progressing.

Preferably the protrusion is forming a limitation to limit a flow-through of material between the outer and inner wear surfaces.

Preferably the protrusion comprises a step-like surface which is forming an angle with the end phase wear surface, which end phase wear surface is continuing under the initial phase wear surface.

Preferably the step-like surface of the protrusion is directed along the horizontal plane or the step-like surface of the protrusion is inclined in relation to the horizontal plane.

Preferably the wear part comprises two or more successive protrusions.

Preferably the end phase wear surface with the protrusion is formed of a material which is more wear resistant than a base material of the wear part, which material is forming the protrusion in the end phase wear surface when the wear is progressing.

Preferably the material which is forming the protrusion and is more wear resistant than the base material of the wear part is embedded at least partly inside the wear part.

Preferably the wear part comprises a separate skirt part which is located vertically under the initial phase wear surface, which skirt part comprises the end phase wear surface with the protrusion.

According to a second aspect of the invention there is provided a mineral material processing apparatus which processing apparatus comprises an outer crushing blade and an inner crushing blade which are forming a crushing chamber and which inner crushing blade is arranged to be moved along an eccentric rotation movement in relation to the outer crushing blade. The processing apparatus comprises a wear part according to the first aspect or according to any preferable embodiment.

According to a third aspect of the invention there is provided a mineral material processing plant which comprises a frame, a base which is attached to the frame for enabling an independent movement, a feeder for feeding material to be crushed and a crusher for crushing the material to be fed. The crusher comprises a wear part according to the first aspect or according to any preferable embodiment.

Advantages of the invention in relation to prior art solutions are, among others,

- a control of a wear profile of the wear part so that crushing efficiency does not substantially decrease at the end of the working life of the wear part
- an effective chamber form, a nip angle/a jaw angle and in that way to maintain the crushing efficiency on an acceptable level to the end of the working life of the wear part
- the working life of the wear part that is longer than before
- a capacity of the crusher remains constant during the whole working life
- a reduction of a risk for a so called cup-forming and permitting a more stable crushing process.

The invention is suitable to be used particularly for wear parts of cone and gyratory type crushers.

DESCRIPTION OF THE DRAWINGS

The invention will be described in more detail with reference to the accompanying principled figures, in which.

For the sake of clarity only such details are shown in the figures which are necessary for understanding the invention. Structures and details which are not necessary for understanding the invention but are self-evident for a skilled person are ignored in the figure in order to highlight the characteristics of the invention.

DETAILED DESCRIPTION OF PREFERABLE EMBODIMENTS

In the following description, like numbers denote like elements. It should be appreciated that the illustrated drawings are not entirely in scale, and that the drawings mainly serve the purpose of illustrating embodiments of the invention.

A crusher in this description means a processing unit of cone and gyratory type which is suitable for material processing.

Figure 1A:
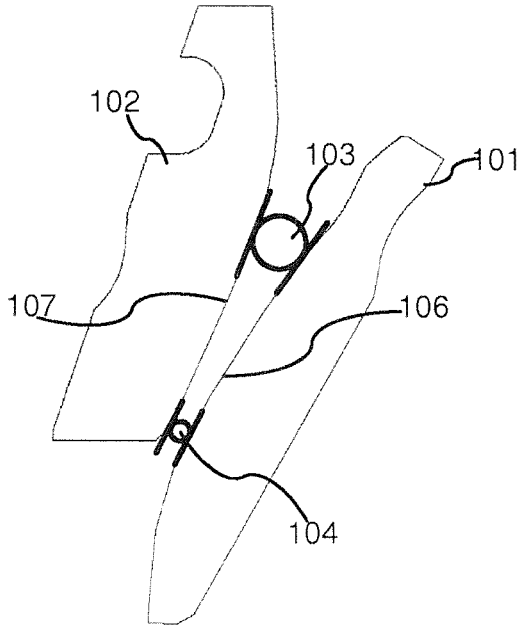
FIG. 1*a* shows a profile view of a crusher chamber at the beginning of the working life of the wear part.

FIG. 1*a* shows a profile view of a crusher chamber profile according to prior art unworn before crushing. A crushing surface 107 of an outer crushing blade 102 and a crushing surface 106 of an inner crushing blade 101 are forming a crushing chamber where crushing of material is taking place when the inner crushing blade is put in an eccentric movement in relation to the outer crushing blade.

The crushing surfaces of the inner 101 and outer 102 crushing blades are forming a nip angle/a jaw angle due to which crushing efficiency of the crusher is maintained on an acceptable level until an end of working life of the wear part. The angle is illustrated with contact points between circles 103 and 104 and crushing surfaces 106 and 107. As can be seen in the figures, in an initial situation the jaw angle increases substantially when moving from a bottom part to an upper part of the crushing chamber.

Figure 1B:
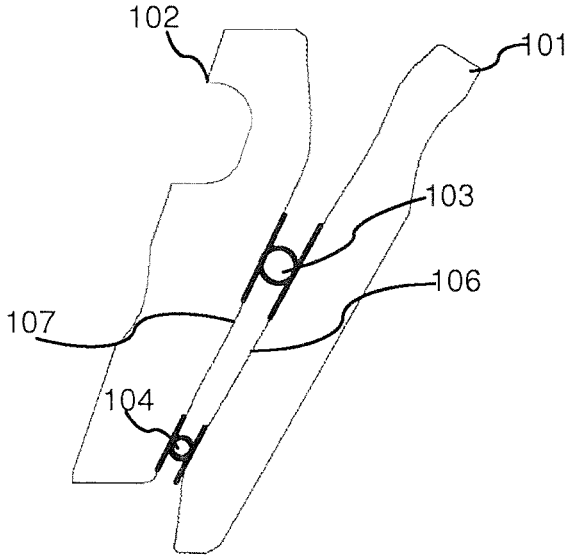
FIG. 1*b* shows the profile view according to FIG. 1*a* at the end of the working life.

FIG. 1*b* shows a profile view of FIG. 1*a* in worn state. As can be seen in the figure, the jaw angle between the crushing blades 101 and 102 is decreased which is illustrated by the contact points between the circles 103 and 104 and the crushing surfaces. Tangents formed in said contact points are substantially more parallel than in the situation of FIG. 1*a*.

Figure 2A:
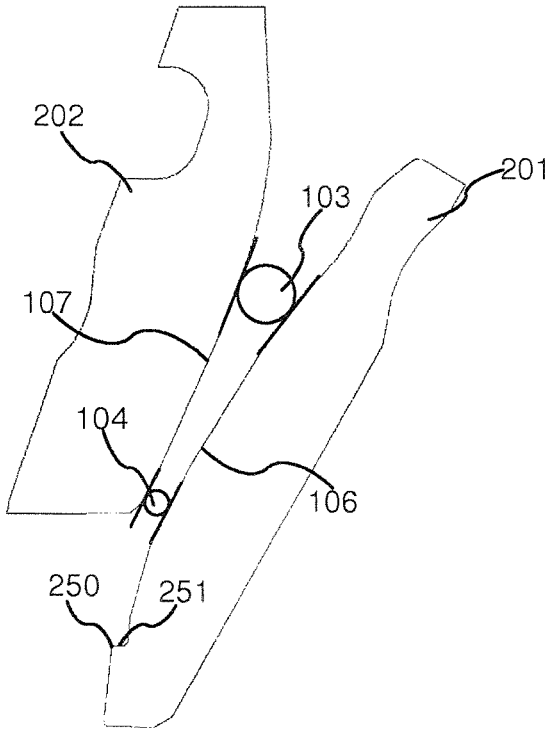
FIG. 2*a* shows a profile view of a wear part according to the invention at the beginning of the working life.

FIG. 2*a* shows a crusher chamber profile according to an embodiment of the invention unworn before initiating the crushing process. An inner crushing blade 201 and an outer crushing blade 202 are shown in the figure. The inner crushing blade 201 comprises a step-like protrusion 250 according to the invention in a bottom part of the crushing surface which is arranged to limit flow of material in the crushing chamber. According to FIG. 2*a*, the protrusion 250 comprises a step-like surface 251 directed along the horizontal plane, which step-like surface is forming an angle with a crushing surface which is located above. The protrusion may also be inclined in relation to the horizontal plane, in one or another direction. Amount of the angle and depth of the protrusion and distance from a bottom edge of the crushing blade can be chosen according to each embodiment.

A protrusion 250 according to the invention does not affect the efficiency of the crusher at this stage. An efficient region of the crushing chamber profile is limited at its lower part to a minimum gap which is a minimum distance between the inner and outer crushing blades or a setting of the crusher. The crushing chamber profile is, due to the protrusion, designed so that the efficiency of the crusher is maximized for the whole working life of the wear part. The efficiency means capacity of the crusher [ton/h], grain distribution of crushed material and quality of grains.

Figure 2C:
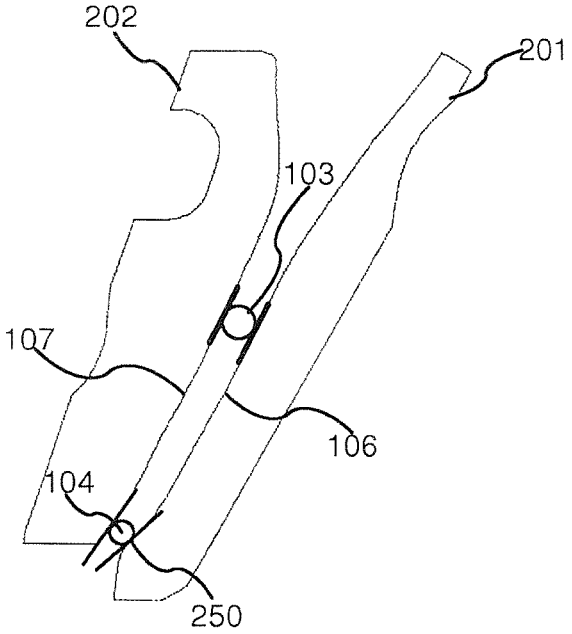
FIG. 2*c* shows the profile view of the wear part according to FIG. 2*a* at the end of the working life.
Figure 2B:
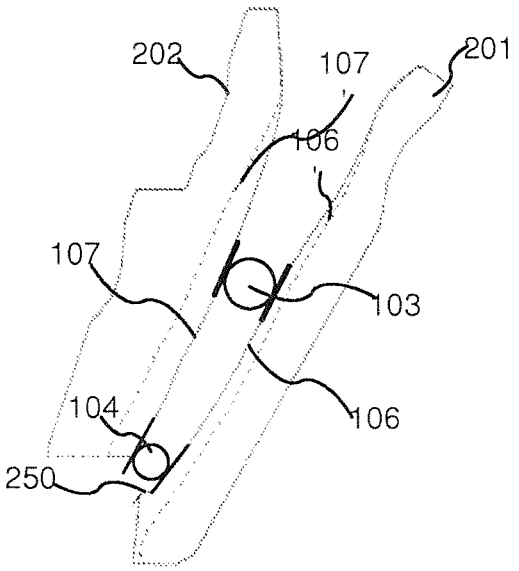
FIG. 2*b* shows the profile view of the wear part according to FIG. 2*a* during the working life.

FIG. 2*b* shows the profile of the crushing chamber according to FIG. 2*a* during the working life. During the crushing process the wear surface of the inner crushing blade is put in crushing contact with the wear surface of the opposite crushing surface. When the crushing process is further proceeding the inner crushing blade is moved in vertical direction in relation to the outer crushing blade, preferably vertically upwards (and/or the upper crushing blade is moved downwards), for compensating the wear. Thus, an end phase wear surface is taken vertically into use from under an initial phase wear surface, when the crushing process is proceeding. The form of the crushing chamber is changing at its upper and bottom portions more parallel, the jaw angle decreases until the end phase wear surface with is put in use when the wear is progressing. In other words, the protrusion 250 according to the invention moves to a crushing surface 106 of the inner crushing blade 201 during the wear of the blades 201 and 202. The jaw angle of the lower part of the crushing chamber starts again to increase, which is illustrated by the increase of the angle between the tangents of contact surfaces between the crushing surfaces 106, 107 and the circle 104 when compared to a corresponding location in FIG. 2*a*. When the jaw angle increases the lower part of the chamber limits the flow of the material to be crushed out of the chamber. The limitation of the flow causes in the chamber an increase in the density of the material to be crushed wherein a larger portion of a movement, or length of a stroke of the crushing, of a movable crushing blade presses the material. When the material is pressed more, more crushing work is taking place and power intake of the crusher and crushing force are increasing, as can be found in FIG. 3*b* and its description below.

FIG. 2*c* shows the crushing chamber profile according to FIG. 2*a* at the end of the working life. The jaw angle has further been preserved in the bottom portion of the chamber as is shown by the angle between tangents of contact surfaces between the circle 104 and the crushing surfaces 106, 107, which angle so is larger than in the situation of FIG. 1*a*. Likewise, the efficient crushing work has been preserved as can be seen in FIG. 3*b* and its description below. The crushing blades are to be changed when an adjustment reserve ends or when the thickness of the blades becomes less than a set minimum limit for them. The efficiency of the crusher has remained on a good level to the end.

Figure 3A:
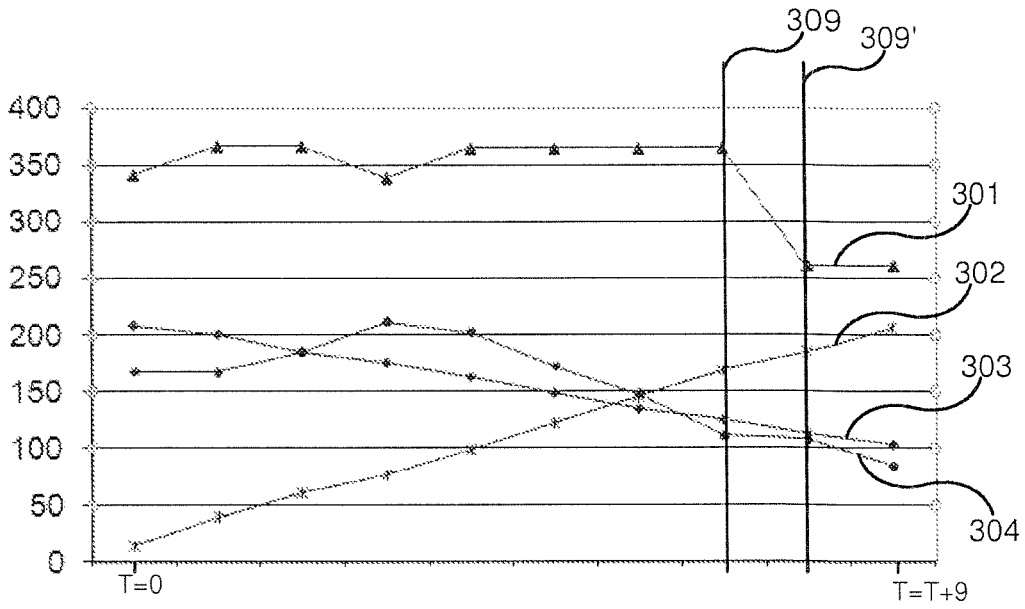
FIG. 3*a* shows measuring data of the operation of the crushing chamber according to FIGS. 1*a*-1*b*.
Figure 3B:
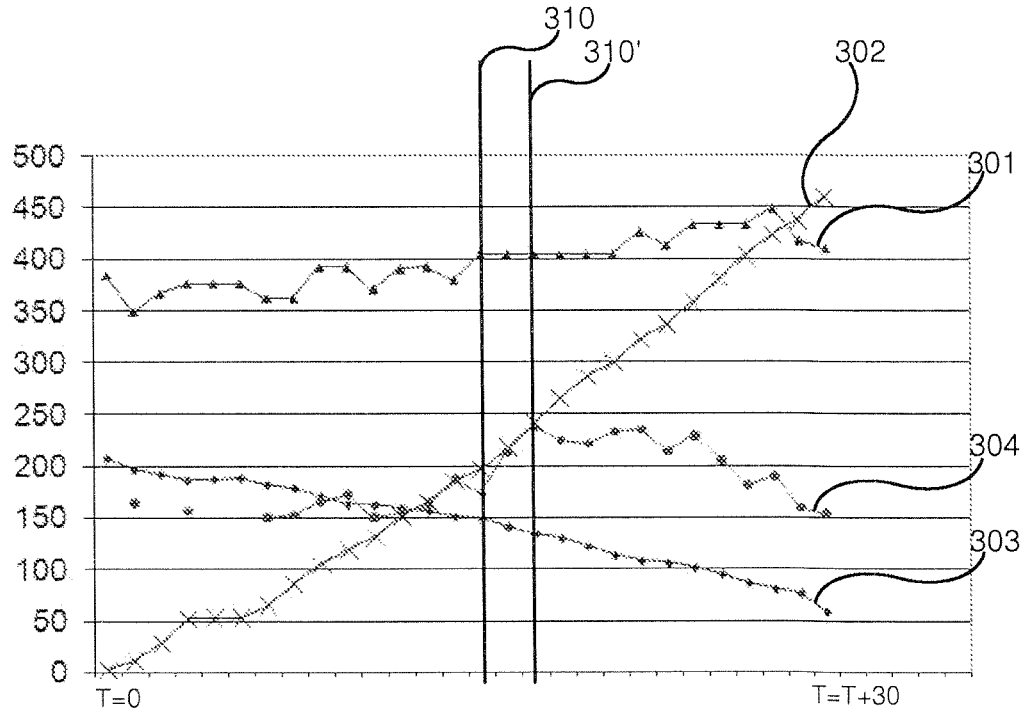
FIG. 3*b* shows measuring data of the operation of the crushing chamber according to FIGS. 2*a*-2*c*.

FIG. 3*a* shows measuring data of the operation of the crushing chamber shown in FIGS. 1*a*-1*b*. In the figure, as the measuring data have been shown crushing capacity 301, working hours 302, movement 303 of the inner crushing blade for compensating the wear and power 304 intake of the crusher during a period of nine days (T=0, T=T+9).

Initially, at the time point T=0 the crushing blades have a wear shape of FIG. 1*a* where the crushing surfaces of the inner and outer crushing blade form a jaw angle relative each other which enables maintaining the crushing efficiency. Close 309, 309' to the end of the crushing process, a reduction in the crushing process takes place and also power intake of the crusher has decreased.

FIG. 3*b* shows measuring data of the operation of the crushing chamber shown in FIGS. 2*a*-2*c*. Crushing capacity 301, working hours 302, movement 303 of the inner crushing blade for compensating the wear and the power intake 304 of the crusher have been shown, according to FIG. 3*a*, as the measuring data (T=0, T=T+30).

In FIG. 3*b*, a point of time 310, 310' is shown when the protrusion of the inner crushing blade according to the invention moves to the region of the crushing chamber to limit the flow of the material in the crushing chamber. The incident is illustrated by an increase of the power intake 304 of the crusher and by staying of the crushing capacity 301 substantially on the same level the whole final working time 302.

Figure 4A:
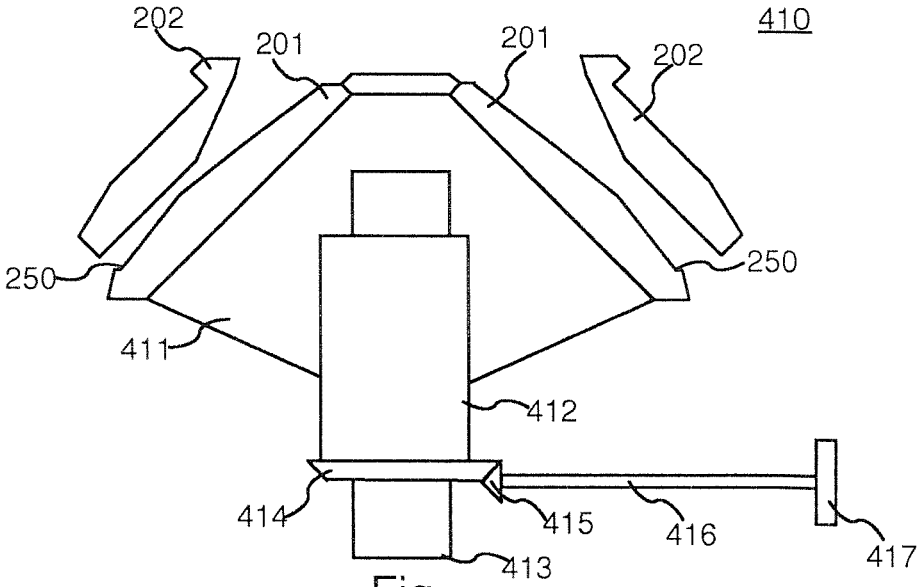
FIG. 4*a* shows a cone crusher according to the invention.

FIG. 4*a* shows a cone crusher 410 according to the invention comprising an outer crushing blade 202, an inner crushing blade 201, a protrusion 250 in the inner crushing blade, a support cone 411, an eccentric sleeve 412 and a main shaft 413. The crusher comprises additionally a transmission such as a gear 414 and 415, a transmission shaft 416 and a pulley 417.

Figure 4B:
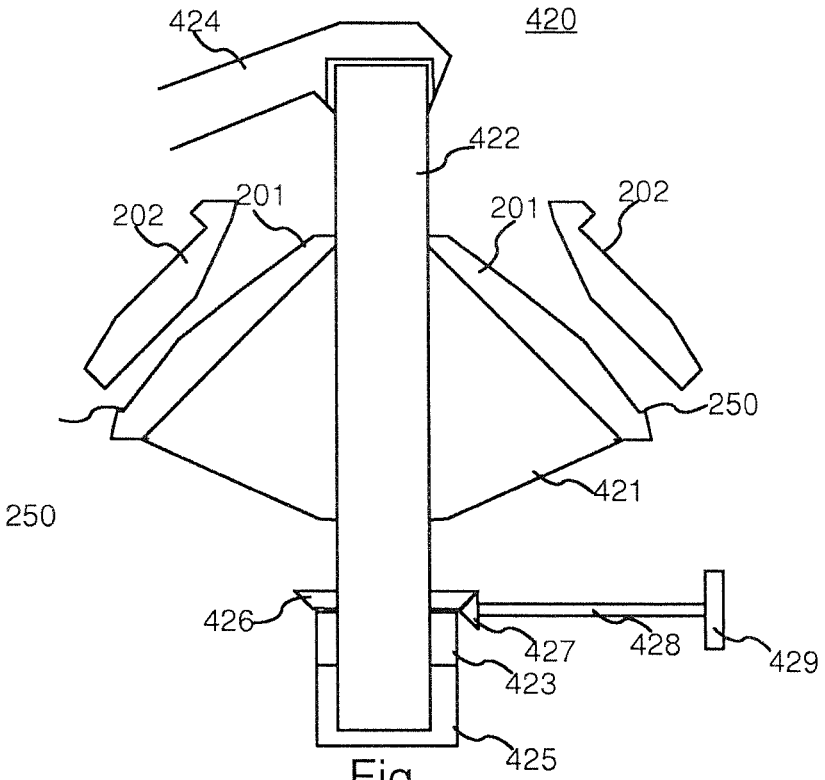
FIG. 4*b* shows a gyratory crusher according to the invention.

FIG. 4*b* shows a gyratory crusher 420 according to the invention comprising an outer crushing blade 202, an inner crushing blade 201, a protrusion 250 in the inner crushing blade, a support cone 421, a main shaft 422, an eccentric sleeve 423, an upper support 424 of the main shaft, a bearing arrangement 425 of the main shaft. The crusher comprises additionally a transmission such as a gear 426 and 427, a transmission shaft 428 and a pulley 429.

Figure 5:
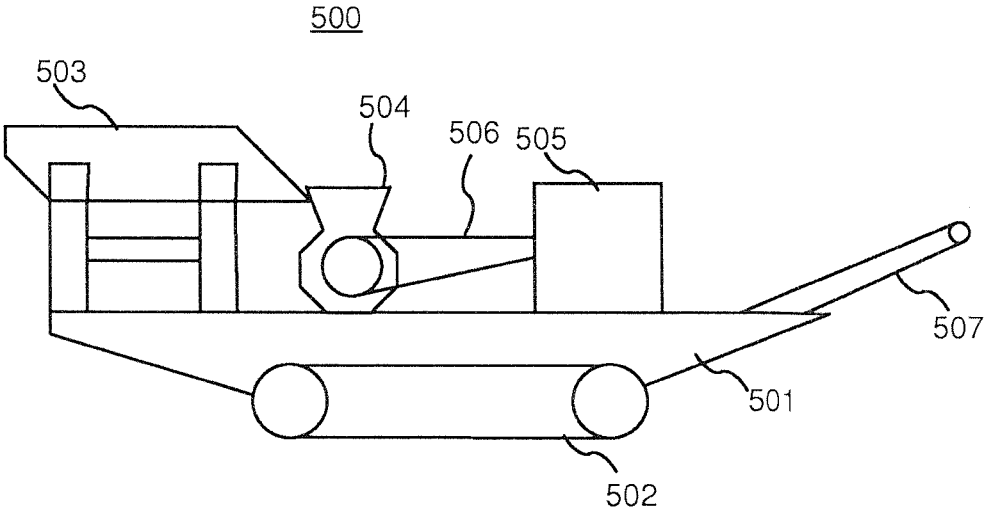
FIG. 5 shows a crushing plant according to the invention.

FIG. 5 shows a crushing plant 500 according to the invention comprising a frame 501, a track base 502 for enabling an independent movement, a feeder 503 for feeding material to be crushed, a crusher 504 for crushing the material to be fed, a power source 505, 506 and at least one material conveyor 507 for delivering crushed material, for example, to a pile at the second end of the processing plant. The crusher 504 may be, for example, the crusher shown in FIGS. 4*a* and 4*b*.

The crushing plant can be implemented also as a so called stationary plant, additionally to what is said above. The track base may be replaced alternatively by legs, runners or wheels.

The wear part according to the invention may be produced preferably directly to its form by casting to a mould wherein the production is simple and cost-effective. The surfaces need not necessarily to be machined at all. Alternatively or additionally, the protrusion may be made to the surface of the crushing blade by removing material, for example, by machining the wear surface such that a portion having a form of the protrusion 250 is forming in the surface of the wear surface. Alternatively or additionally, material may be added to the wear surface, for example, by welding so that the protrusion 250 is forming in the wear surface. The material to be added may be a more wear resistant material than the base material of the wear part. Alternatively or additionally, the protrusion 250 may be made as a separate skirt part under the conical wear part. Then, the skirt forming the protrusion is forming a portion of the end phase wear surface to be put in crushing contact with the opposite crushing blade when the wear is progressing. Alternatively or additionally, the protrusion 250 and, if desired, the wear part under it may be made of a more wear resistant material than the base material of the wear part, for example, by casting the wear part of two different materials. The separate skirt part may be made of a more wear resistant material than the base material of the wear part. When the wear is progressing, the base material wears faster than the material at the location of the protrusion wherein the protrusion according to the invention is formed in the end phase wear surface. The material forming the protrusion 250 which is more wear resistant than the base material is preferably embedded at least partly inside the wear part. The material which is more wear resistant than the base material may be embedded totally inside the wear part under the end phase wear surface.

The foregoing description provides non-limiting examples of some embodiments of the invention. It is clear to a person skilled in the art that the invention is not restricted to details presented, but that the invention can be implemented in other equivalent means.

Some of the features of the above-disclosed embodiments may be used to advantage without the use of other features. As such, the foregoing description shall be considered as merely illustrative of the principles of the invention, and not in limitation thereof. Hence, the scope of the invention is only restricted by the appended patent claims.

The invention claimed is:

1. A mineral material processing apparatus comprising an outer wear part and an inner wear part that form a crushing chamber therebetween and which inner wear part is arranged to be moved along an eccentric rotation movement in relation to the outer wear part, wherein the inner wear part comprises an outer wear surface which comprises a working life initial phase wear surface to be put in crushing contact with an opposite wear surface of the outer wear part, and a working life end phase wear surface to be brought vertically into use as part of the crushing chamber in the crushing process from under the working life initial wear surface when the wear is progressing, wherein the working life end phase wear surface includes a protrusion configured to be located outside of the crushing chamber during an initial phase of the working life and to form part of the crushing chamber when the wear of the outer wear surface is progressing.

2. The mineral material processing apparatus according to claim 1, wherein the protrusion forms a limitation to a flow-through of material between the outer and inner wear surfaces.

3. The mineral material processing apparatus according to claim 1, wherein the protrusion comprises a step shaped surface that forms an angle with the end phase wear surface, which end phase wear surface continues below the initial phase wear surface.

4. The mineral material processing apparatus according to claim 3, wherein the step shaped surface of the protrusion is directed along a generally horizontal plane.

5. The mineral material processing apparatus according to claim 3, wherein the step shaped surface of the protrusion is inclined in relation to a generally horizontal plane.

6. The mineral material processing apparatus according to claim 1, wherein the inner wear part comprises two or more successive protrusions.

7. The mineral material processing apparatus according to claim 1, wherein the protrusion is formed of a material which is more wear resistant than a base material of the inner wear part, which material forms the protrusion in the end working life phase wear surface when the wear is progressing.

8. The mineral material processing apparatus according to claim 1, wherein the material that forms the protrusion is embedded at least partly inside the inner wear part.

9. The mineral material processing apparatus according to claim 1, wherein the inner wear part comprises a separate skirt part located vertically under the initial phase wear surface, which skirt part comprises the working life end phase wear surface.

10. The mineral material processing apparatus of claim 1 wherein the mineral material processing apparatus is a cone crusher.

11. The mineral material processing apparatus of claim 1 wherein the mineral material processing apparatus is a gyratory crusher.

12. The mineral material processing apparatus of claim 1 wherein the mineral material processing apparatus is a cone crusher.

13. A mineral material processing plant comprising a frame, a base for enabling an independent movement, a feeder for feeding material to be crushed and a crusher for crushing the material to be fed, wherein the base and the feeder are attached to the frame, the crusher further comprising an outer wear part and an inner wear part including an outer wear surface which comprises a working life initial phase wear surface to be put in crushing contact with an opposite wear surface of the outer wear part, and a working life end phase wear surface to be brought vertically into use in the crushing process from under the working life initial wear surface when the wear is progressing, wherein the working life end phase wear surface includes a protrusion configured to be located outside of the crushing chamber during an initial phase of the working life and to be put in use when the wear of the outer wear surface is progressing.

14. The mineral material processing plant of claim 13 wherein the mineral material processing plant is a cone crusher.

* * * * *